US005855923A

United States Patent [19]

Gustavsson

[11] Patent Number: 5,855,923

[45] Date of Patent: Jan. 5, 1999

[54] DEVICE FOR LEVELLING A PARTICULATE MATERIAL WEB

[75] Inventor: Lennart Gustavsson, Växjö, Sweden

[73] Assignee: ABB Flakt AB, Nacka, Sweden

[21] Appl. No.: 849,108

[22] PCT Filed: Nov. 24, 1995

[86] PCT No.: PCT/SE95/01402

§ 371 Date: Jul. 24, 1997

§ 102(e) Date: Jul. 24, 1997

[87] PCT Pub. No.: WO96/16776

PCT Pub. Date: Jun. 6, 1996

[30] Foreign Application Priority Data

Nov. 28, 1994 [SE] Sweden ..... 9404103

[51] Int. Cl.[6] ..... B28B 5/02

[52] U.S. Cl. ..... 425/83.1; 425/216

[58] Field of Search ..... 425/216, 217, 425/83.1; 141/280

[56] References Cited

U.S. PATENT DOCUMENTS

| | | | |
|---|---|---|---|
| 979,547 | 12/1910 | Norton | 425/83.1 |
| 3,067,456 | 11/1962 | Himmelheber et al. | 425/217 |
| 4,167,378 | 9/1979 | Hagg et al. | 425/217 |
| 4,998,869 | 3/1991 | Kessing et al. | 425/83.1 |
| 5,013,229 | 5/1991 | Ufermann et al. | 425/83.1 |

FOREIGN PATENT DOCUMENTS

| | | | |
|---|---|---|---|
| 973865 C | 6/1960 | Germany . | |
| 1514617 | 10/1989 | U.S.S.R. | 425/83.1 |

*Primary Examiner*—Robert Davis

[57] ABSTRACT

A device for levelling a particulate material web (3), such as a wood-fibre mat laid out on a wire (2) and intended for the production of wood-fibre boards, the material web being moved in relation to the device, comprises a rotary shaft (4) and a plurality of elliptic discs (6) mounted thereon. The shaft (4) is adapted to be arranged transversely of the direction of movement of the material web (3) and extends through the centers of the discs (6). The discs (6) are mounted at an axial distance from one another so as to rotate with the shaft (4). About their minor axes, the discs (6) are so inclined in relation to the shaft (4) as to have a circular axial projection.

4 Claims, 2 Drawing Sheets

DEVICE FOR LEVELLING A PARTICULATE MATERIAL WEB

BACKGROUND OF THE INVENTION

1. Field of the Invention

This invention concerns a device for levelling a particulate material web, such as a wood-fibre mat laid out on a wire and intended for the production of wood-fibre boards, said material web being moved in relation to the device.

2. Description of Background Art

In the production of wood-fibre boards, glue-coated wood fibres are pneumatically conveyed from a container to a forming station. In this station, the wood fibres are laid out in the form of a mat on a wire, by means of which the fibres are conveyed to a pressing plant, where they are pressed into fibre boards under given pressure and temperature conditions. On its way to the pressing plant, the fibre mat passes a milling roller which is arranged transversely of the direction of conveyance and which mills the fibre mat to give it a smooth upper surface as well as a suitable thickness and a suitable weight before the pressing operation. The fibres removed from the fibre mat in the milling operation are recycled to the container, so as to subsequently be returned to the forming station and be laid out on the wire. The amount of wood fibres separated by the milling roller is fairly large and may, in some applications, be up to 25%. Since the amount of fibres separated and thus recirculated is fairly large, the fibres are worn and dehydrated to a disproportionate extent. Furthermore, the glue consumption and the power requirement of the fibre conveyance become excessive.

SUMMARY OF THE INVENTION

The object of this invention is, therefore, to provide a levelling device complementing the prior-art milling roller, thereby to considerably reduce the amount of fibres separated and recirculated.

According to the invention, this object is achieved by a device which is of the type mentioned by way of introduction and which is characterised by a rotary shaft, which is adapted to be arranged transversely of the direction of movement of the material web and on which a plurality of elliptic discs, through the centres of which extends the shaft, are mounted at an axial distance from one another so as to rotate with the shaft, the discs being so inclined about their minor axes in relation to the shaft as to have a circular axial projection.

In a preferred embodiment, the discs are mounted at such an axial distance from one another that adjoining discs overlap in the axial direction.

Conveniently, the discs are inclined at an angle of 45°–80°, preferably about 60°.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The invention will now be described in more detail with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
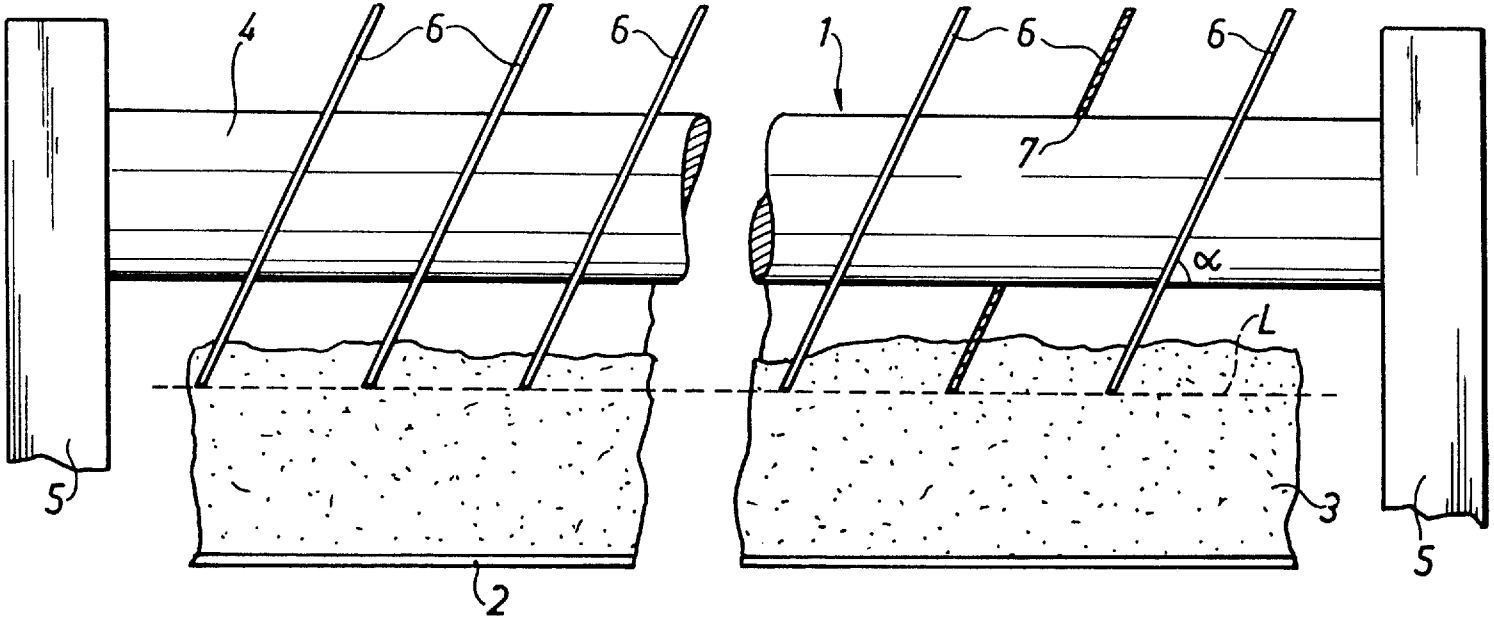
FIG. 1 is a side view of a device according to the invention.

Thus, FIG. 1 shows a levelling device 1 according to the invention, which is mounted above a wire 2 on which is laid out a material web 3 in the form of a wood-fibre mat. The material web 3 passes the device 1 on its way from a forming station (not shown) to a pressing plant (not shown) for the production of fibre boards.

The device 1 comprises a shaft 4, which has a circular cross-section and extends transversely of the direction of conveyance of the wire 2 and the material web 3 and which, at its ends, is rotatably mounted in a frame 5. In a manner not shown in detail, the shaft 4 is vertically adjustable to enable the device to be adapted to the thickness of the material web 3.

The shaft 4 supports a plurality of identical discs 6, which are fixed to the shaft 4 with an axial spacing. The discs 6 are evenly distributed along the shaft 4 in such a manner that adjoining discs 6 overlap In the axial direction.

Each disc 6 has the shape of an ellipse. The shaft 4 extends through a centre hole 7 (only illustrated in the case of a disc shown in section in FIG. 1) in each disc 6, this centre hole 7 having the shape of an ellipse whose major axis coincides with that of the ellipse of the disc. About its minor axis A1 (FIG. 2), which in FIG. 1 is perpendicular to the plane of the drawing, each disc 6 is inclined at an angle a to the shaft 4. This angle $\alpha$ may vary between 45° and 80° but preferably is 60°, as in the embodiment illustrated in FIG. 1.

Figure 2:
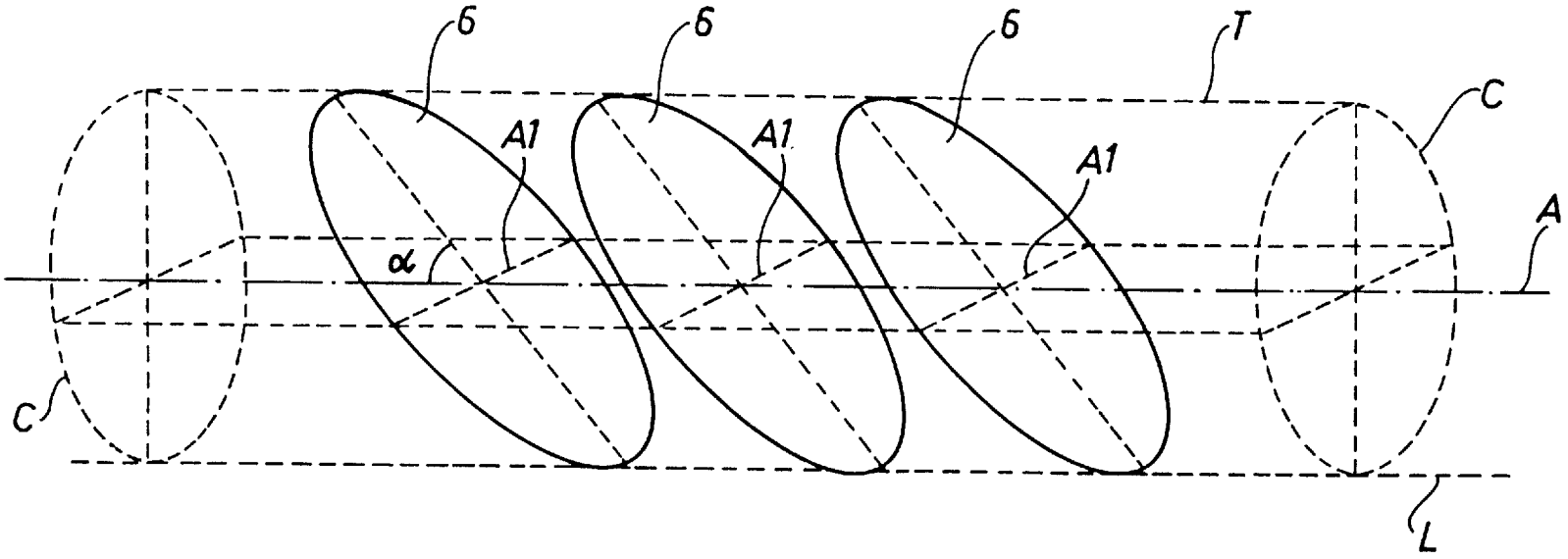
FIG. 2 is a schematic perspective view illustrating in more detail the geometric relationships of the component parts of the device.

The discs 6 have such an elliptic shape and are so inclined about their minor axes A1 (see FIG. 2) as to have a circular axial projection, which in FIG. 2 is illustrated with the aid of two broken-line circles C. When the shaft 4 rotates about its axis A (FIG. 2), which extends through the centres of the discs 6, each point on the circumferences of the discs 6 thus describes, as seen in axial projection, a circle whose diameter equals the length of the minor axis A1 of the ellipse of the disc. During this rotation, the discs 6 perform an axially reciprocating throwing movement inside the imaginary, horizontal and straight tube T whose cross-section is defined by the two circles C (see FIG. 2). The lowermost point of the discs 6, which is located on the circumferential surface of the imaginary tube T, is then axially reciprocated along a straight line L and levels the material web 3 to the level of this line.

When vertically adjusted in suitable fashion and used as a complement to the prior-art milling roller described by way of introduction, the above levelling device according to the invention considerably reduces the amount of fibres separated and recirculated.

In each of the examples illustrated in FIGS. 1 and 2, all the discs 6 occupy the same rotational position as regards rotation about the shaft 4. This need not, however, be the case, and the discs 6 may separately or in groups occupy different rotational positions with respect to the shaft 4, if only the inclination about the minor axis A1 of the ellipse is the same (60° in FIG. 1) for all the discs 6, such that the axial projection of all the discs 6 consists of one and the same circle.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A device for levelling a particulate material web, said material web being moved in relation to the device, characterised by a rotary shaft, which is adapted to be arranged transversely of the direction of movement of the material web and on which a plurality of elliptic discs, through the centres of which extends the shaft, are mounted at an axial distance from one another so that to rotate with the shaft, the discs being so inclined about their minor axes in relation to the shaft as to have a circular axial projection.

2. The device as set forth in claim 1, characterised in that the discs are mounted at such an axial distance from one another that adjoining discs overlap in the axial direction.

3. The device as set forth in claim 1, characterised in that the discs are inclined at an angle of 45°–80°.

4. The device as set forth in claim 3, characterised in that the discs are inclined at an angle of about 60°.

* * * * *